US005868251A

United States Patent [19]

Lin

[11] Patent Number: 5,868,251

[45] Date of Patent: Feb. 9, 1999

[54] DISK-SHAPED STORAGE CASE FOR SCREWDRIVER TIPS

[76] Inventor: Wan-Chang Lin, No. 3, Industrial Rd., Ta-Li Industrial Zone,Taiping Hsiang, Taichung, Taiwan

[21] Appl. No.: 965,457

[22] Filed: Nov. 6, 1997

[51] Int. Cl.[6] ..... B65D 85/20; A47F 7/00

[52] U.S. Cl. ..... 206/372; 206/818; 211/70.6; 211/DIG. 1

[58] Field of Search ..... 206/372, 375, 206/379, 234, 376, 377, 818; D9/415; 211/DIG. 1, 70.6

[56] References Cited

U.S. PATENT DOCUMENTS

| | | | |
|---|---|---|---|
| D. 341,777 | 11/1993 | Sheu | D9/415 |
| D. 370,626 | 6/1996 | Pass et al. | D9/415 |
| 2,323,574 | 7/1943 | Smith | 206/375 |
| 2,573,311 | 10/1951 | Cupler, II | 206/379 |
| 5,255,795 | 10/1993 | Kitmitto | 706/818 X |
| 5,535,882 | 7/1996 | Liu | 206/377 |
| 5,704,260 | 1/1998 | Huang | 206/378 X |

*Primary Examiner*—Bryon P. Gehman
*Attorney, Agent, or Firm*—W. Wayne Liauh

[57] ABSTRACT

A storage case is disclosed for storing screwdriver tips. It includes a circular body and a rotary disk. The circular body is provided with a plurality of storage slots arranged circularly for keeping a plurality of screwdriver tips. The rotary disk is fastened pivotally with the circular body such that the circular body is superimposed by the rotary disk. The rotary disk is provided with a tip retrieving hole corresponding in location to the storage slots of the circular body. The tip retrieving hole is provided at one end thereof with an arcuate block having a bevel through hole for receiving a magnetic block capable of attracting one of the plurality of screwdriver tips, when the tip retrieving hole of the rotary disk is located over a predetermined storage slot of the circular body.

2 Claims, 8 Drawing Sheets

DISK-SHAPED STORAGE CASE FOR SCREWDRIVER TIPS

FIELD OF THE INVENTION

The present invention relates generally to a storage case for screwdriver tips, and more particularly to a circular storage case for easy storage and retrieval of the screwdriver tips.

BACKGROUND OF THE INVENTION

As illustrated in FIG. 1, a screwdriver is provided at the free end of a shaft 1 thereof with a hexagonal hole 3 for holding tips 2 of various forms. The tips 2 are kept in a circular storage case 4, as shown in FIG. 2. The storage case 4 is provided with a rotary disk 5 fastened pivotally therewith. The rotary disk 5 is provided with a retrieving hole 6. In the process of retrieving a screwdriver tip kept in the storage case 4, the rotary disk 5 is rotated such that the screwdriver tip is aligned with the retrieving hole 6 to be dumped out of the storage case 4.

Such a prior art storage case 4 as described above is rather primitive in design in that the screwdriver tips can not be easily retrieved from the storage case 4 in which the screwdriver tips are kept.

SUMMARY OF THE INVENTION

The primary objective of the present invention is to provide an improved storage case with a magnetic device capable of easy and fast retrieval of a screwdriver tip kept in the storage case of the present invention.

In keeping with the principle of the present invention, the foregoing objective of the present invention is attained by a disk-shaped storage case consisting of a rotary disk having a tip retrieving hole. The tip retrieving hole is provided with a press block having a bevel through hole. A magnetic block is located in the bevel through hole such that the magnetic block is capable of attracting the screwdriver tip at the time when the tip retrieving hole is opposite in location to the tip.

The foregoing objective, features, functions, and advantages of the present invention will be more readily understood upon a thoughtful deliberation of the following detailed description of the present invention with reference to the accompanying drawings.

DETAILED DESCRIPTION OF THE INVENTION

Figure 1:
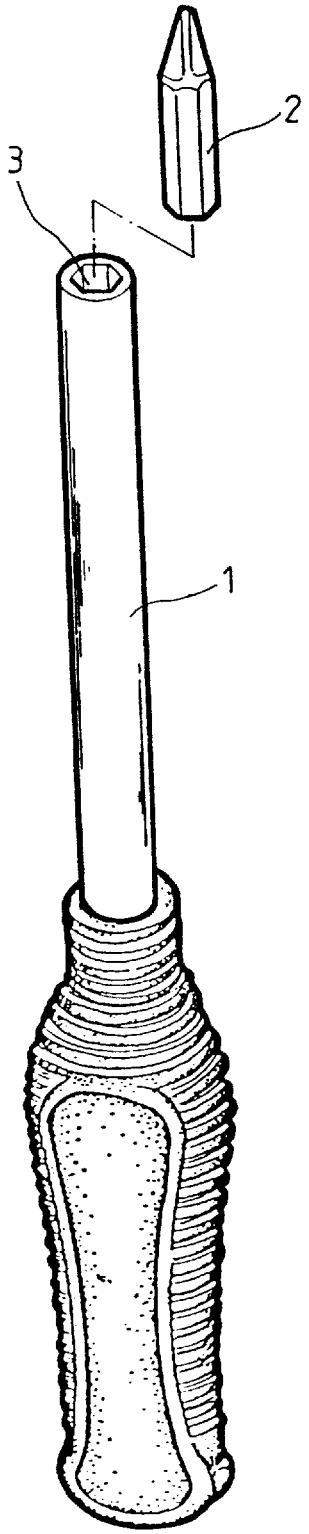
Fig. 1 PRIOR ART
FIG. 1 shows a schematic view of a screwdriver having a detachable tip.
Figure 2:
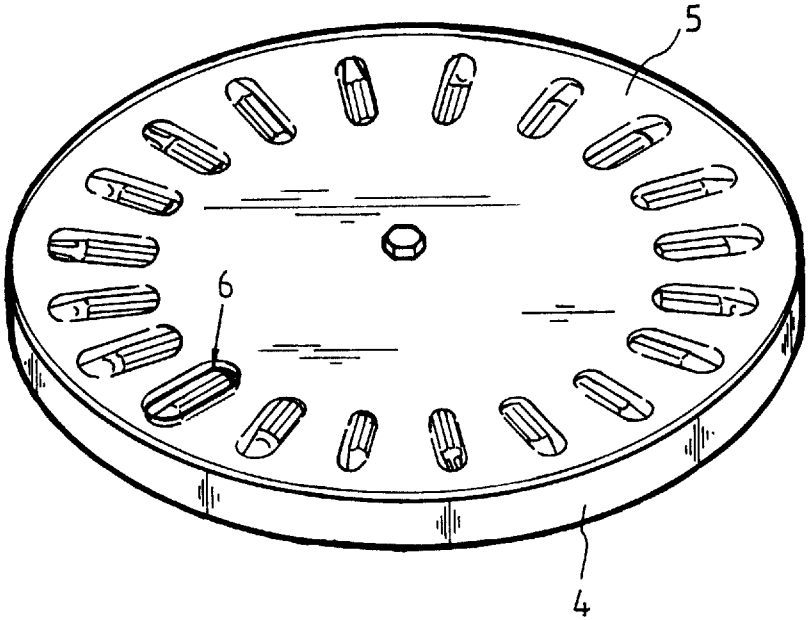
Fig. 2 PRIOR ART
FIG. 2 shows a schematic view of a prior art disk-shaped storage case for screwdriver tips.
Figure 3:
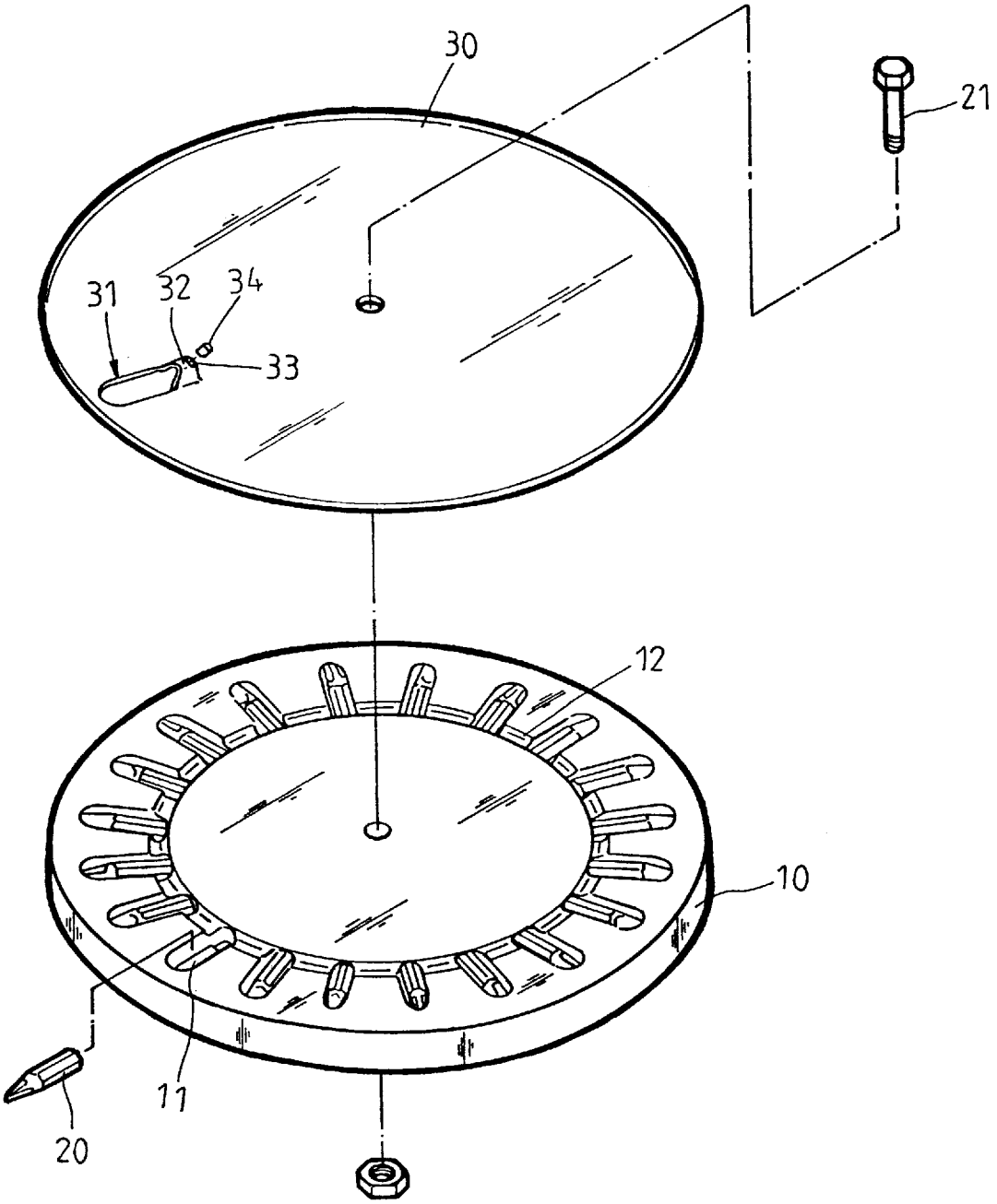
FIG. 3 shows an exploded view of a disk-shaped storage case of the present invention for keeping screwdriver tips.
Figure 4:
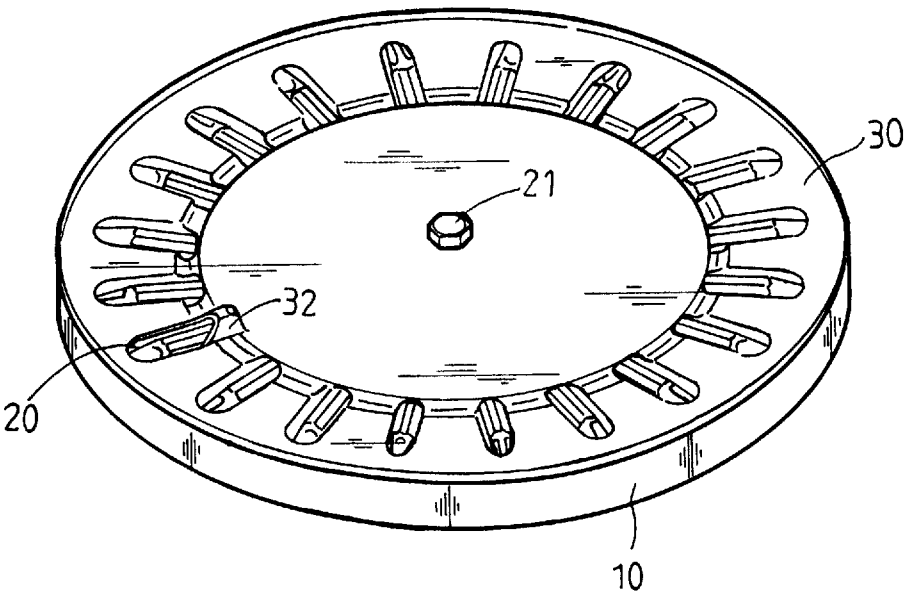
FIG. 4 shows a schematic view of the present invention in combination.

As shown in FIGS. 3 and 4, a disk-shaped storage case of the embodiment of the present invention has a disklike body

10 which is provided in the upper surface thereof with a plurality of storage slots 11 arranged circularly for keeping therein the screwdriver tips 20. The upper surface of the body 10 is provided with a transparent rotary disk 30 which is engaged with the body 10 by means of a pivot 21 such that the rotary disk 30 can be turned on the pivot 21. The rotary disk 30 is provided with a tip retrieving hole 31 corresponding in location to the storage slots 11 of the body 10. The tip retrieving hole 31 is provided in the arcuate inner end edge thereof with an arcuate press block 32, which is made integrally with the rotary disk 30. The press block 32 is provided with a bevel through hole 33 in which a magnetic block 34 is lodged such that the surface of the magnetic block 34 and the upper surface of the body 10 form a bevel. The body 10 is further provided in the upper surface thereof with a circular groove 12 along which the bevel bottom of the magnetic block 34 can be moved.

Figure 5:
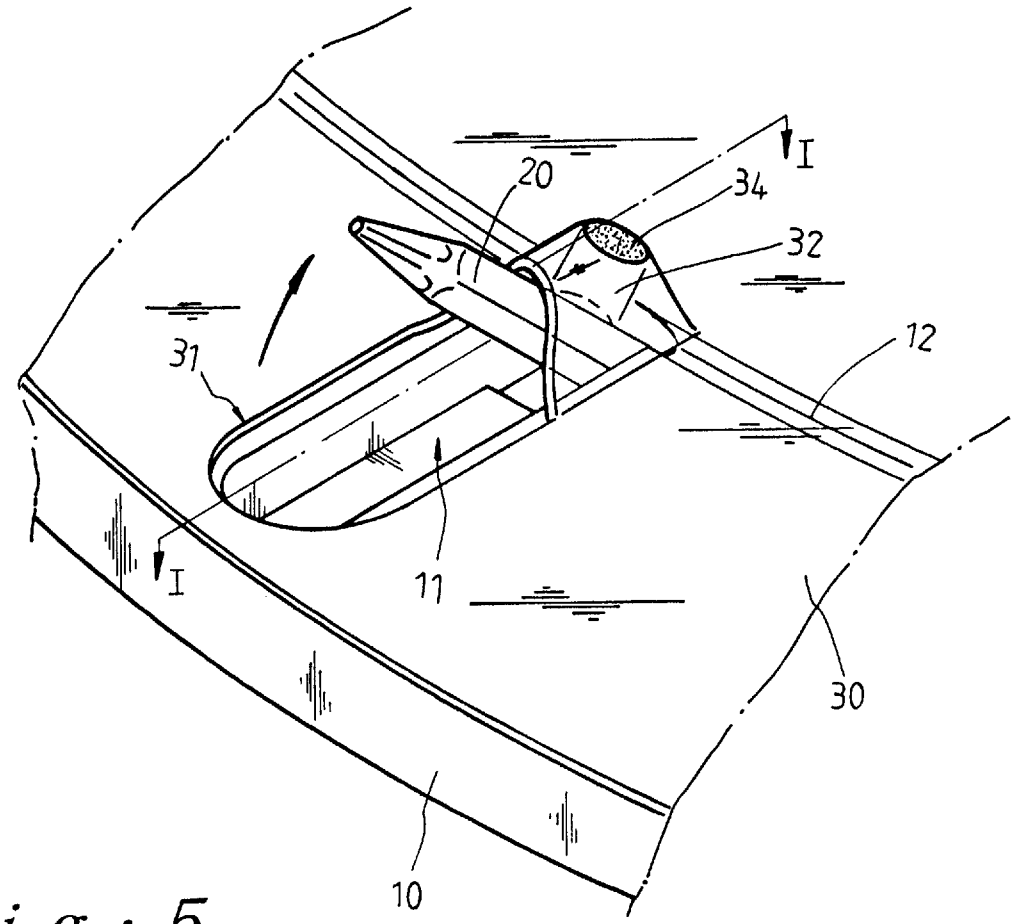
FIG. 5 shows a partial enlarged view of the present invention.
Figure 6:
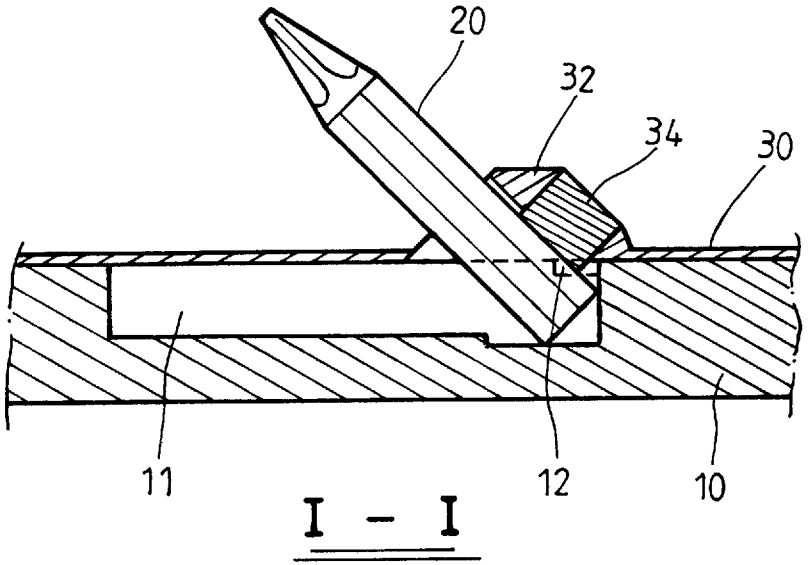
FIG. 6 shows a sectional view of a portion taken along the direction indicated by a line I—I as shown in FIG. 5.

As illustrated in FIGS. 5 and 6, the rotary disk 30 is turned on the pivot 21 until the tip retrieving hole 31 is aligned with the storage slot 11 in which a desired screwdriver tip 20 is kept. As the tip retrieving hole 31 is located right over the desired screwdriver tip 20, which is then picked up by the magnetic block 34. Since the magnetic block 34 is corresponding in location to the tail end of the tip 20, the head end of the tip 20 is jutted out of the tip retrieving hole 31 at the time when the tip 20 is picked up by the magnetic block 34. It is therefore readily apparent that any one of the tips 20 kept in the storage slots 11 can be easily retrieved.

Figure 7:
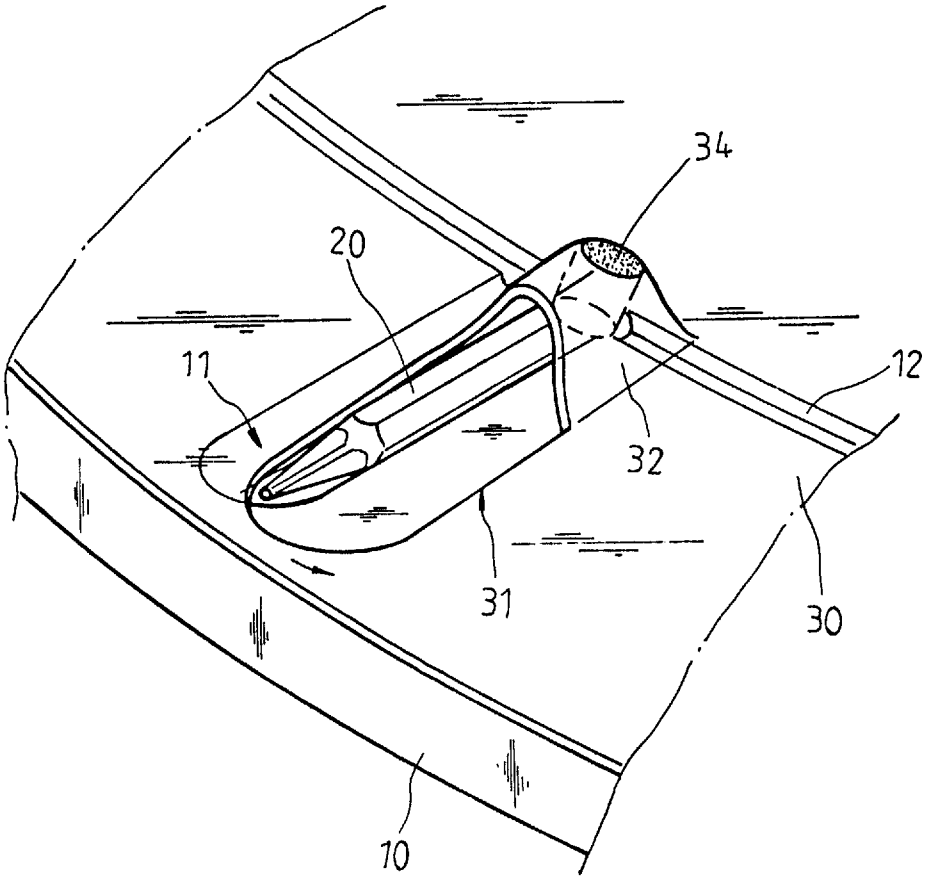
FIG. 7 shows another partial enlarged view of the present invention.
Figure 8:
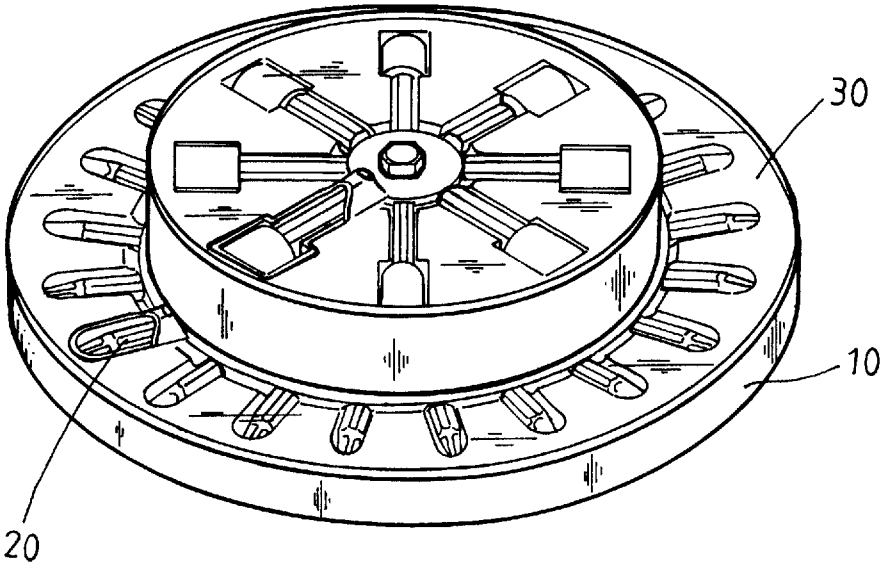
FIG. 8 shows a schematic view of another embodiment of the present invention.

As shown in FIG. 7, the retrieved tip 20 can be easily returned to the storage slot 11 from which the tip 20 was retrieved. One end of the tip 20 is held by the magnetic block 34 such that the tip 20 is warped, and that the sides of the tip 20 are confined by the wall of the storage slot 11. As the rotary disk 30 is rotated, the press block 32 is displaced to cause the arcuate inner end edge of the tip retrieving hole 31 to force the tip 20 to descend, thereby resulting in the disengagement of the tip 20 with the magnetic block 34. The tip 20 is subsequently dropped into the storage slot 11.

The embodiment of the present invention described above is to be regarded in all respects as being merely illustrative and not restrictive. Accordingly, the present invention may be embodied in other specific forms without deviating from the spirit thereof. For example, the present invention may be provided with a disklike body which is rotatably attached to the body 10 for keeping the accessories of the screwdriver tips 20. The disklike body for storing the accessories of the screwdriver tips 20 is similar in construction to the body 10. The present invention is therefore to be limited only by the scopes of the following appended claims.

What is claimed is:

1. A storage case for keeping screwdriver tips, said storage case comprising:

a circular body provided in an upper surface thereof with a plurality of storage slots arranged circularly for keeping screwdriver tips; and a rotary disk fastened pivotally with said upper surface of said circular body and provided with a tip retrieving hole corresponding in location to said storage slots of said circular body, said tip retrieving hole being provided at one end thereof with an arcuate press block having a bevel through hole;

a magnetic block disposed in said bevel through hole capable of attracting screwdriver tips kept in said storage slots;

further wherein said upper surface of said circular body has a circular groove, and said magnetic block has a bevel end capable of moving along said circular groove of said circular body when said rotary disk is rotated in relation to said circular body.

2. The storage case as defined in claim 1, wherein said circular body is provided with another circular body having a plurality of storage slots for keeping accessories of the screwdriver tips, said another circular body being fastened pivotally with said circular body such that said rotary disk is superimposed by said another circular body.

* * * * *